US010890185B2

(12) United States Patent
Denis et al.

(10) Patent No.: US 10,890,185 B2
(45) Date of Patent: Jan. 12, 2021

(54) SCROLL COMPRESSOR HAVING A CENTRAL MAIN DISCHARGE PORT AND AN AUXILIARY DISCHARGE PORT

(71) Applicant: Danfoss Commercial Compressors, Trevoux (FR)

(72) Inventors: Sebastien Denis, Fontaines sur Saone (FR); David Genevois, Cailloux sur Fontaine (FR); Julien Lavy, Trevoux (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 202 days.

(21) Appl. No.: 16/108,693

(22) Filed: Aug. 22, 2018

(65) Prior Publication Data

US 2019/0063432 A1 Feb. 28, 2019

(30) Foreign Application Priority Data

Aug. 29, 2017 (FR) ..... 17 57965

(51) Int. Cl.
*F04C 18/02* (2006.01)
*F04C 29/12* (2006.01)
*F04C 23/00* (2006.01)

(52) U.S. Cl.
CPC ..... *F04C 18/0269* (2013.01); *F04C 18/0215* (2013.01); *F04C 18/0261* (2013.01);
(Continued)

(58) Field of Classification Search
CPC ..... F04C 18/0269; F04C 18/0215; F04C 8/0261; F04C 23/008; F04C 29/12; F04C 2250/102
(Continued)

(56) References Cited

U.S. PATENT DOCUMENTS 6,120,268 A 9/2000 Bush et al.
9,267,501 B2 2/2016 Akei
(Continued)

FOREIGN PATENT DOCUMENTS

CN 1727680 A 2/2006
CN 101240796 A 8/2008
(Continued)

OTHER PUBLICATIONS

French Search Report for Serial Nos. FA 842559 and FR 1757965 dated Apr. 17, 2018.
(Continued)

*Primary Examiner* — Connor J Tremarche
(74) *Attorney, Agent, or Firm* — McCormick, Paulding & Huber PLLC

(57) ABSTRACT

The scroll compressor comprises a fixed scroll element comprising a fixed end plate (13) and a fixed spiral wrap (14); an orbiting scroll element comprising an orbiting end plate and an orbiting spiral wrap (16), the fixed and orbiting spiral wraps (14, 16) being intermeshed with each other to define pairs of compression pockets, a radial inner pair of compression pockets comprising a direct pocket (17.1) and an indirect pocket (17.2); a central main discharge port (18) formed in the fixed end plate (13) and configured to communicate the direct pocket (17.1) with a discharge pressure volume; and an auxiliary discharge port (26) formed in the fixed end plate (13) at a position close to an outer wall side (14.2) of the fixed spiral wrap (14) and adjacent the inner end (14.4) of the fixed spiral wrap (14). The auxiliary discharge port (26), during orbiting movement of the orbiting scroll element (12), is at least partially uncovered by the orbiting spiral wrap (16) to communicate the indirect pocket (17.2) with the discharge pressure volume.

19 Claims, 3 Drawing Sheets

(52) U.S. Cl.
CPC ..... *F04C 23/008* (2013.01); *F04C 29/12* (2013.01); *F04C 2250/102* (2013.01)

(58) Field of Classification Search
USPC ..... 418/55.2
See application file for complete search history.

(56) References Cited

U.S. PATENT DOCUMENTS

| | | | | |
|---|---|---|---|---|
| 2010/0303659 | A1 | 12/2010 | Stover et al. | |
| 2014/0205484 | A1* | 7/2014 | Ignatiev | F01C 1/0215 418/55.3 |
| 2016/0363121 | A1* | 12/2016 | Yamada | F04C 28/26 |
| 2018/0073507 | A1 | 3/2018 | Choi et al. | |

FOREIGN PATENT DOCUMENTS

| | | | |
|---|---|---|---|
| CN | 101675248 | A | 3/2010 |
| CN | 203114622 | U | 8/2013 |
| CN | 104074755 | A | 10/2014 |
| CN | 204511881 | U | 7/2015 |
| CN | 105473863 | A | 4/2016 |
| EP | 1913236 | B1 | 10/2012 |
| EP | 2549109 | A2 | 1/2013 |
| EP | 2703648 | A1 | 3/2014 |
| JP | 2011149376 | A | 8/2011 |
| JP | 2014196692 | A | 10/2014 |
| JP | 2016169689 | A | 9/2016 |

OTHER PUBLICATIONS

Indian First Examination Report for Application No. 201814026512 dated Jun. 24, 2020.

* cited by examiner

SCROLL COMPRESSOR HAVING A CENTRAL MAIN DISCHARGE PORT AND AN AUXILIARY DISCHARGE PORT

CROSS-REFERENCE TO RELATED APPLICATION

This application claims foreign priority benefits under U.S.C. § 119 to French Patent Application No. FR17/57965 filed on Aug. 29, 2017, the content of which is hereby incorporated by reference in its entirety.

TECHNICAL FIELD

The present invention relates to a scroll compressor.

BACKGROUND

A scroll compressor may include in a known manner:

a hermetic housing, a fixed scroll element arranged within the housing and comprising a fixed end plate and a fixed spiral wrap extending from the fixed end plate, an orbiting scroll element arranged within the housing and comprising an orbiting end plate and an orbiting spiral wrap extending from the orbiting end plate, the fixed and orbiting spiral wraps being intermeshed with each other to define, with the fixed and orbiting end plates, pairs of compression pockets, the volume of the compression pockets decreasing from outer ends towards inner ends of the orbiting and fixed spiral wraps during orbiting movement of the orbiting scroll element, a radial inner pair of compression pockets comprising a direct pocket and an indirect pocket, and a central main discharge port formed in the fixed end plate and configured to communicate, during orbiting movement of the orbiting scroll element, the direct pocket with a discharge pressure volume formed within the hermetic housing.

The direct pocket is defined as that pocket of the innermost pair of compression pockets, which opens directly into the central main discharge port formed in the fixed end plate of the fixed scroll element. The corresponding indirect pocket is defined as the other pocket of the innermost pair of compression pockets, which opens into the central main discharge port only when the inner end tip of the orbiting spiral wrap moves away from an inner wall side of the fixed spiral wrap and both direct and indirect pockets are getting combined.

At the beginning of a discharge process of the direct and indirect pockets, the compressed refrigerant from indirect pocket has to pass a still narrow gap between the inner end tip of the orbiting spiral wrap and the inner wall side of the fixed spiral wrap. The available flow section for compressed gas from the direct pocket towards the central main discharge port increases much faster than the available flow section from the indirect pocket.

Following this, a slight over-compression of the refrigerant in the indirect pocket occurs compared to the refrigerant in the direct pocket. At partial or low load conditions, this over-compression reduces the compressor efficiency, as the compressed refrigerant from the indirect pocket expands into the discharge pressure volume, which has a lower pressure than the maximum pressure of the indirect pocket.

Solutions are known from the prior art to improve the discharge flow of refrigerant from the indirect pocket.

To control the timing at which compressed refrigerant gas is delivered from the indirect pocket towards the discharge pressure volume, it is known from EP2703648 to form a dummy port recess adjacent the inner end of the orbiting spiral wrap in the bottom surface of the orbiting end plate, from which extends the orbiting spiral wrap.

However, to achieve correct timing, the shape of the dummy port recess has to be adapted to the spiral shape of the fixed and orbiting spiral wraps and is expensive to manufacture.

Other prior art solutions are shown in U.S. Pat. No. 6,120,268 and EP1913236, where the inner end tips of the fixed and orbiting spiral wraps are modified to achieve similar flow conditions for the refrigerant in both direct and indirect pockets and to avoid over-compression.

These modifications of the spiral wraps are however complicated and expensive to manufacture.

SUMMARY

It is an object of the present invention to provide an improved scroll compressor which can overcome the drawbacks encountered in conventional scroll compressor.

Another object of the present invention is to provide a scroll compressor which has an improved efficiency and low global cost compared to the conventional scroll compressors.

According to the invention such a scroll compressor comprises:

a hermetic housing, a fixed scroll element arranged within the hermetic housing and comprising a fixed end plate and a fixed spiral wrap extending from the fixed end plate, an orbiting scroll element arranged within the hermetic housing and comprising an orbiting end plate and an orbiting spiral wrap extending from the orbiting end plate, the fixed and orbiting spiral wraps being intermeshed with each other to define, with the fixed and orbiting end plates, pairs of compression pockets, the volume of the compression pockets decreasing from outer ends towards inner ends of the fixed and orbiting spiral wraps during orbiting movement of the orbiting scroll element, a radial inner pair of compression pockets comprising a direct pocket and an indirect pocket, a central main discharge port formed in the fixed end plate and configured to communicate, i.e. to fluidly connect, during orbiting movement of the orbiting scroll element, the direct pocket with a discharge pressure volume formed within the hermetic housing, characterized in that an auxiliary discharge port is formed in the fixed end plate at a position close to an outer wall side of the fixed spiral wrap and adjacent the inner end of the fixed spiral wrap, and in that the auxiliary discharge port, during orbiting movement of the orbiting scroll element, is at least partially uncovered by the orbiting spiral wrap to communicate, i.e. to fluidly connect, the indirect pocket with the discharge pressure volume.

The auxiliary discharge port particularly contributes to increase the flow section from the indirect pocket, especially at the beginning of the discharge process, faster than in a design without auxiliary discharge port. Consequently the presence of auxiliary discharge port reduces the over-compression of the indirect pocket, and thus improves the efficiency of the scroll compressor.

Further the presence of the auxiliary discharge port reduces stress on the inner end of the fixed spiral wrap, which reduces the risk of breaking of the fixed spiral wrap 14 and thus improves the reliability of the scroll compressor.

Moreover, the auxiliary discharge port may be made by drilling, which substantially reduces the manufacturing cost of the scroll compressor.

The scroll compressor may also include one or more of the following features, taken alone or in combination.

According to an embodiment of the invention, the auxiliary discharge port is fluidly connected to the discharge pressure volume.

According to an embodiment of the invention, the central main discharge port is fluidly connected to the discharge pressure volume.

According to an embodiment of the invention, the auxiliary discharge port, during orbiting movement of the orbiting scroll element, is entirely uncovered by the orbiting spiral wrap to communicate the indirect pocket with the discharge pressure volume.

According to an embodiment of the invention, the auxiliary discharge port is formed by at least one auxiliary discharge hole formed in the fixed end plate. Such a configuration of the auxiliary discharge port particularly significantly reduces the manufacturing costs of the scroll compressor due to the simple design of the auxiliary discharge port.

According to an embodiment of the invention, the at least one auxiliary discharge hole is cylindrical.

According to an embodiment of the invention, the at least one auxiliary discharge hole is oblong.

According to an embodiment of the invention, the at least one auxiliary discharge hole extends substantially perpendicularly to the fixed end plate.

According to an embodiment of the invention, the at least one auxiliary discharge hole has a diameter smaller than a thickness of the orbiting spiral wrap.

According to an embodiment of the invention, the auxiliary discharge port is formed by several auxiliary discharge holes formed in the fixed end plate. Such a configuration of the auxiliary discharge port allow an easy timing by changing the position of the auxiliary discharge holes at the inner end of the fixed spiral wrap. Further, changing the size and/or number of auxiliary discharge holes allows to optimize the compressor efficiency for specific load conditions.

According to an embodiment of the invention, the auxiliary discharge port is formed by three auxiliary discharge holes. It has turned out that that an embodiment with three auxiliary discharge holes is the best compromise to ensure improvement of the compressor efficiency at all load conditions.

According to an embodiment of the invention, the several auxiliary discharge holes are configured to be successively uncovered by the orbiting spiral wrap, during orbiting movement of the orbiting scroll element, to communicate the indirect pocket with the discharge pressure volume.

According to an embodiment of the invention, the at least one auxiliary discharge hole or each auxiliary discharge hole has a diameter between 3 and 7 mm, advantageously between 4 and 5 mm, and for example around 4.5 mm.

According to an embodiment of the invention, the central main discharge port is cylindrical.

According to an embodiment of the invention, the central main discharge port has a diameter between 15 and 25 mm, advantageously between 19 and 21 mm, and for example around 20 mm.

According to an embodiment of the invention, the several auxiliary discharge holes include an innermost auxiliary discharge hole which is adjacent the inner end of the fixed spiral wrap and which is adjacent the central main discharge port.

According to an embodiment of the invention, the several auxiliary discharge holes are aligned along a curved line.

According to an embodiment of the invention, the central main discharge port is formed in the fixed end plate at a position close to an inner wall side of the fixed spiral wrap and adjacent the inner end of the fixed spiral wrap.

According to an embodiment of the invention, the orbiting scroll element is configured to substantially simultaneously communicate the direct pocket with the central main discharge port and the indirect pocket with the auxiliary discharge port at a beginning of a discharge process of the direct and indirect pockets.

According to an embodiment of the invention, the fixed scroll element includes a sealing device arranged in an end face of the fixed spiral wrap and sealingly cooperating with the orbiting end plate of the orbiting scroll element.

According to an embodiment of the invention, the sealing device is elongated and extends along at least a part of a length of the fixed spiral wrap, and for example along at least 70% of the length of the fixed spiral wrap.

According to an embodiment of the invention, the sealing device includes a sealing inner end located at a position close to the inner end of the fixed spiral wrap.

These and other advantages will become apparent upon reading the following description in view of the drawing attached hereto representing, as non-limiting example, one embodiment of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

Figure 1:
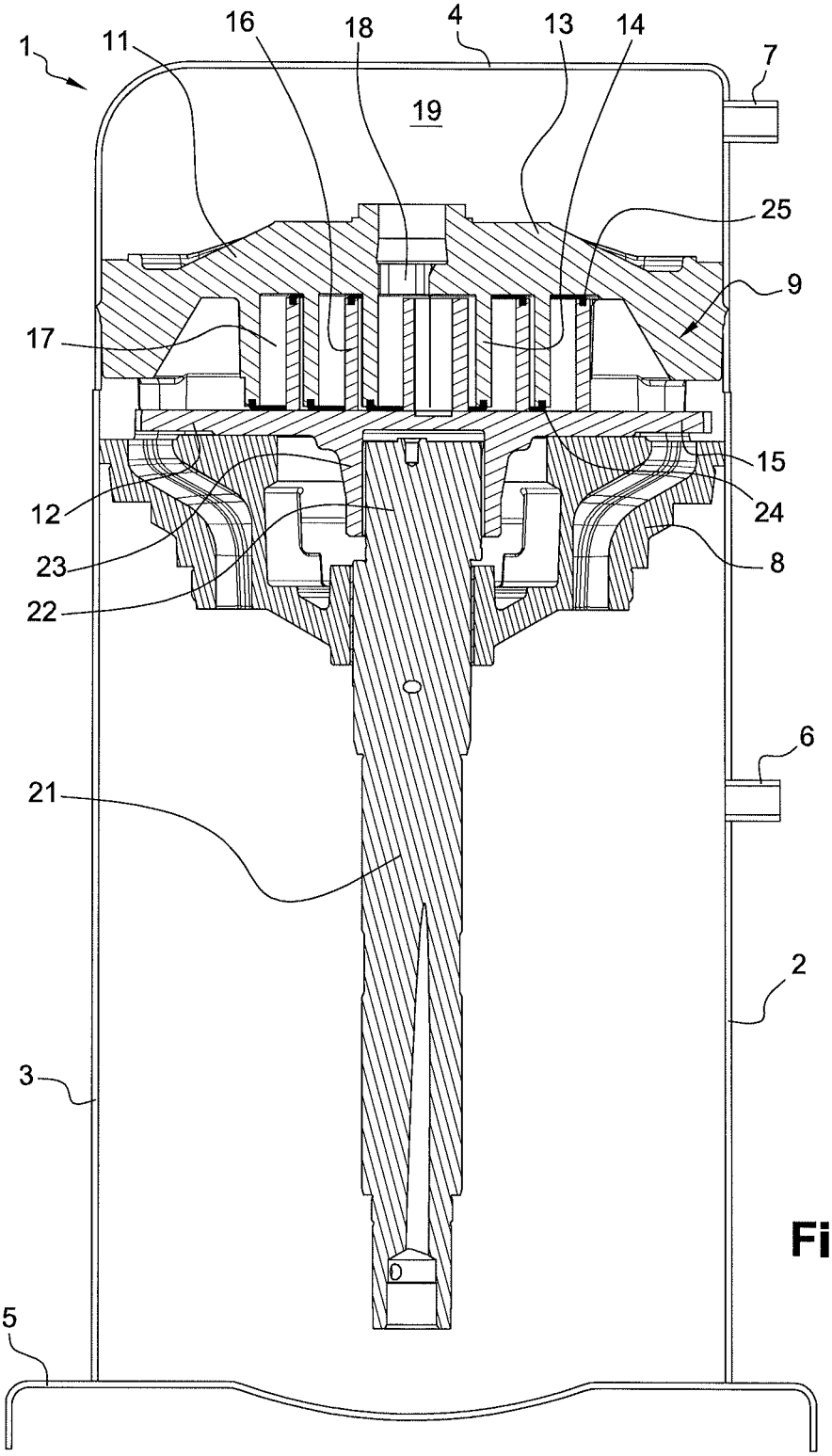
FIG. 1 is a longitudinal section view of a scroll compressor according to the invention.

FIG. 1 shows a scroll compressor 1 including a hermetic housing 2 having a generally cylindrical shell 3, a cap 4 fixed at an upper end of the generally cylindrical shell 3, and a base 5 fixed at a lower end of the generally cylindrical shell 3. The generally cylindrical shell 3 is provided with a suction inlet 6 configured to supply the scroll compressor 1 with refrigerant to be compressed, and the cap 4 is provided with a discharge outlet 7 configured to discharge compressed refrigerant.

The scroll compressor 1 further includes a support member 8, also named crankcase, fixed to the hermetic housing 2, and a scroll compression device 9 arranged within the hermetic housing 2 and supported by the support member 8. The scroll compression device 9 is configured to compress the refrigerant supplied through the suction inlet 6. The scroll compression device 9 includes a fixed scroll element 11 and an orbiting scroll element 12.

The fixed scroll element 11 includes a fixed end plate 13 and a fixed spiral wrap 14 projecting from the fixed end plate 13 towards the orbiting scroll element 12. The fixed spiral wrap 14 includes an inner wall side 14.1 directed towards a center portion of the fixed end plate 13, and an outer wall side 14.2 opposite to the inner wall side 14.1 and directed towards the outer periphery of the fixed end plate 13.

The orbiting scroll element 12 includes an orbiting end plate 15 slidably mounted on the support member 8, and an orbiting spiral wrap 16 projecting from the orbiting end plate 15 towards the fixed scroll element 11. The orbiting spiral wrap 16 includes an inner wall side 16.1 directed towards a center portion of the orbiting end plate 15, and an outer wall side 16.2 opposite to the inner wall side 16.1 and directed towards the outer periphery of the orbiting end plate 15.

The orbiting spiral wrap 16 of the orbiting scroll element 12 meshes with the fixed spiral wrap 14 of the fixed scroll element 11 to define, with the fixed and orbiting end plates 13, 15, pairs of compression pockets 17 between them. Each of the compression pockets 17 has a variable compression volume which decreases from outer ends 14.3, 16.3 towards inner ends 14.4, 16.4 of the fixed and orbiting spiral wraps 14, 16, i.e. inwardly towards a center portion of the fixed and orbiting scroll elements 11, 12, when the orbiting scroll element 12 is driven to orbit relative to the fixed scroll element 11. The pairs of compression pockets 17 particularly include a radial inner pair of compression pockets comprising a direct pocket 17.1 and an indirect pocket 17.2.

The scroll compression device 9 further includes a central main discharge port 18 provided at a central portion of the fixed end plate 13 of the fixed scroll element 11, and configured to discharge compressed refrigerant from the direct and indirect pockets 17.1, 17.2 into a discharge pressure volume 19 formed within the hermetic housing 2, and particularly defined by the cap 4 and the fixed end plate 13, during orbiting movement of the orbiting scroll element 12. The central main discharge port 18 is thus fluidly connected to the discharge pressure volume 19.

According to the embodiment shown on the figures, the central main discharge port 18 is cylindrical and is formed in the fixed end plate at a position close to the inner wall side 14.1 of the fixed spiral wrap 14 and adjacent the inner end of the fixed spiral wrap 14. The central main discharge port may have a diameter between 15 and 25 mm, advantageously between 19 and 21 mm, and for example around 20 mm. The opening of the central main discharge port may also have non-circular and non-symmetric shapes.

Furthermore the scroll compressor 1 includes a drive shaft 21 configured to drive the orbiting scroll element 12 in orbital movements relative to the fixed scroll element 11. Particularly the drive shaft 21 has, at its upper end, an eccentric driving portion 22 received in a cylindrical hub 23 protruding from the lower face of the orbiting scroll element 12.

Figure 2:
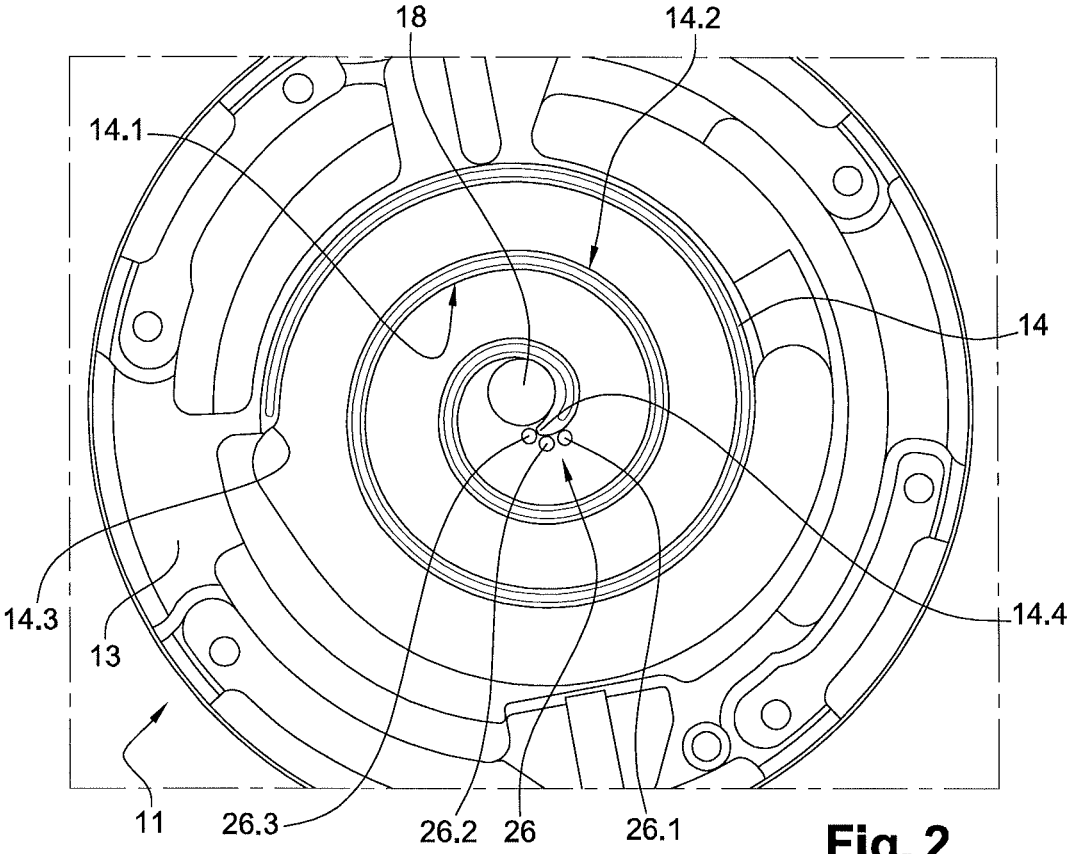
FIG. 2 is a partial bottom view of a fixed scroll element of the scroll compressor of FIG. 1.

The scroll compressor 1 also includes a first sealing devices 24 arranged in an end face of the fixed spiral wrap 14 and sealingly cooperating with the orbiting end plate 15 of the orbiting scroll element 12, and second sealing devices 25 arranged in an end face of the orbiting spiral wrap 16 and sealingly cooperating with the fixed end plate 13 of the fixed scroll element 11. As better shown on FIG. 2, each of the first and second sealing devices 24, 25 is made in one piece and has a spiral shape. Each of the first and second sealing devices 24, 25 may extend along at least 70% of the length of the respective spiral wrap. Advantageously, each of the first and second sealing devices 24, 25 includes a sealing inner end located at a position close to the inner end of the respective spiral wrap.

The scroll compressor 1 further includes an auxiliary discharge port 26 formed in the fixed end plate 13 at a position close to the outer wall side 14.2 of the fixed spiral wrap 14 and adjacent the inner end 14.4 of the fixed spiral wrap 14. The auxiliary discharge port 26 is fluidly connected to the discharge pressure volume 19.

According to the embodiment shown on the figures, the auxiliary discharge port 26 is formed by several auxiliary discharge holes 26.1, 26.2, 26.3 formed in the fixed end plate 13 and aligned along a curved line. Each of the auxiliary discharge holes 26.1, 26.2, 26.3 may be cylindrical and may have a diameter between 3 and 7 mm, advantageously between 4 and 5 mm, and for example around 4.5 mm. According to another embodiment of the invention, each of the auxiliary discharge holes 26.1, 26.2, 26.3 may be oblong. Advantageously, each of the cylindrical auxiliary discharge holes 26.1, 26.2, 26.3 has a diameter smaller than a thickness of the orbiting spiral wrap 16. Generally, the dimensions of the openings of the auxiliary discharge holes and their position along the curved line are chosen, so they can be completely covered by the orbiting spiral wrap during part of an orbiting cycle movement.

According to an embodiment of the invention, the several auxiliary discharge holes 26.1, 26.2, 26.3 include an innermost auxiliary discharge hole 26.3 which is adjacent the inner end 14.4 of the fixed spiral wrap 14 and which is adjacent the central main discharge port 18.

The several auxiliary discharge holes 26.1, 26.2, 26.3 are particularly configured to be successively and entirely uncovered by the orbiting spiral wrap 16, during orbiting movement of the orbiting scroll element 12, to communicate the indirect pocket 17.2 with the discharge pressure volume 19.

A discharge process of the direct and indirect pockets 17.1, 17.2 during compressor operation is partially shown on FIGS. 3 to 8, where several steps of a first part of the discharge process can be seen.

Figure 3:
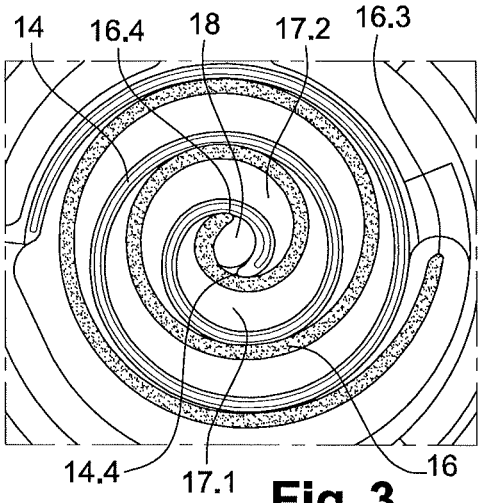
FIGS. 3 to 8 are partial cross section views of the scroll compressor of FIG. 1, showing several steps of a discharge process of direct and indirect pockets of the scroll compressor.

As shown in FIG. 3, which corresponds to the beginning of the discharge process, i.e. at t=0 s, the orbiting spiral wrap 16 still seals the direct and indirect pockets 17.1, 17.2 from the main and auxiliary discharge ports 18, 26. Particularly, at this step of the discharge process, the auxiliary discharge holes 26.1, 26.2, 26.3 are covered by the orbiting spiral wrap 16.

Figure 4:
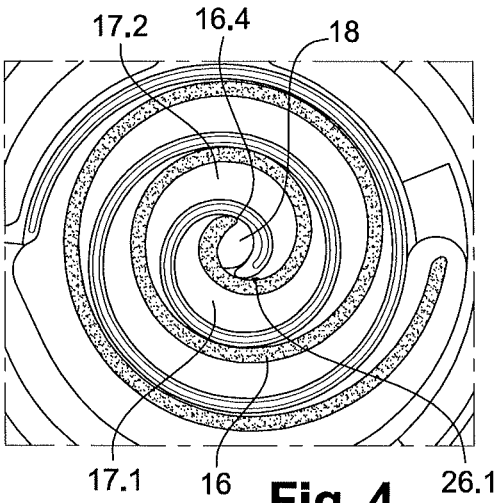

FIG. 4 corresponds to a second step of the discharge process, for example at t=1 ms, where the orbiting spiral wrap 16 substantially simultaneously communicate the direct pocket 17.1 with the central main discharge port 18 and the indirect pocket 17.2 with the first auxiliary discharge hole 26.1. Particularly, at this step of the discharge process, the orbiting spiral wrap 16 partially uncovered the first auxiliary discharge hole 26.1 to communicate the indirect pocket 17.2 with the discharge pressure volume 19.

Figure 5:
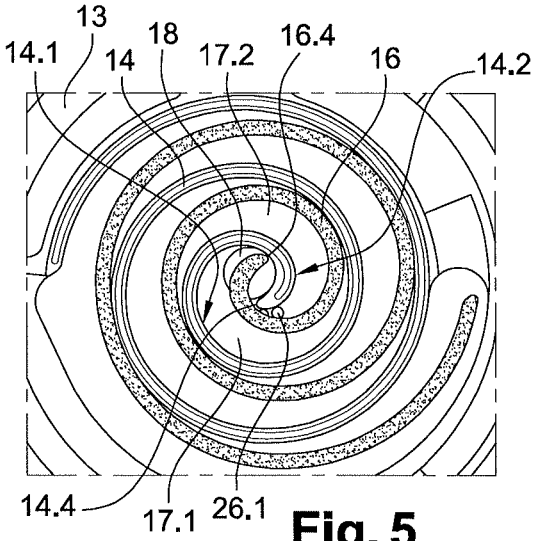

FIG. 5 corresponds to a third step of the discharge process, for example at t=2 ms, where the first auxiliary discharge hole 26.1 of the auxiliary discharge port 26 is almost completely uncovered by the orbiting spiral wrap 16 and a radial gap is now formed between the inner end 16.4 of the orbiting spiral wrap 16 and the inner wall side 14.1 of the fixed spiral wrap 14. First and second flow paths are now available for the compressed refrigerant from the indirect pocket 17.2 towards the discharge pressure volume 19: the first flow path through the auxiliary discharge port 26, and the second flow path through the radial gap and the central main discharge port 18. Advantageously, at this step of the discharge process, the second auxiliary discharge hole 26.2 of the auxiliary discharge port 26 is also partially uncovered by the orbiting spiral wrap 16.

Figure 6:
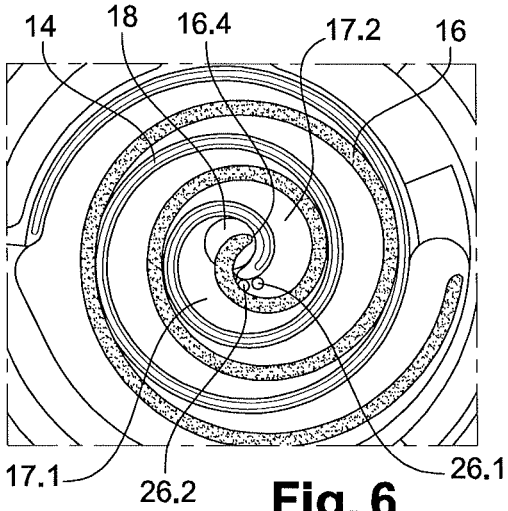
Figure 7:
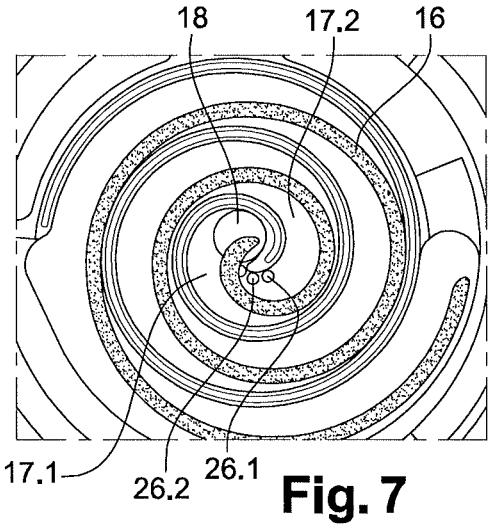
Figure 8:
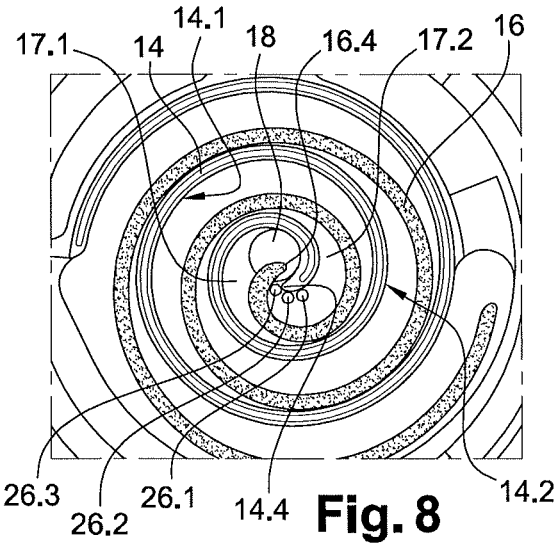

During the further steps of the discharge process shown on FIGS. 6 to 8, which correspond for example respectively to t=4 ms, t=6 ms and t=8 ms, the movement of the orbiting scroll warp 16 successively uncovers the second and third auxiliary discharge holes 26.2, 26.3 of the auxiliary discharge port 26. At the same time, the indirect and direct pocket volumes are increasingly combined due to the progressing separation of the inner end 16.4 of the orbiting spiral wrap 16 from the inner wall side 14.1 of the fixed spiral wrap 14. During this period, the discharge refrigerant flow from the indirect pocket 17.2 is dominated by the refrigerant flow around the inner end 16.4 of the orbiting spiral wrap 16. At t=8 ms, which corresponds to FIG. 8, all the auxiliary discharge holes of the auxiliary discharge port 26 are uncovered, and the maximum section for the discharge flow out of the indirect pocket 17.2 is reached.

The auxiliary discharge port 26 particularly contributes to increase the flow section from the indirect pocket 17.2, especially at the beginning of the discharge process, faster than in a design without auxiliary discharge port. Such a configuration of auxiliary discharge port 26 reduces the over-compression of the indirect pocket 17.2, and thus improves the efficiency of the scroll compressor.

Further the presence of the auxiliary discharge port 26 reduces stress on the inner end 14.4 of the fixed spiral wrap 14, which reduces the risk of breaking of the fixed spiral wrap 14 and thus improves the reliability of the scroll compressor.

Of course, the invention is not restricted to the embodiment described above by way of non-limiting example, but on the contrary it encompasses all embodiments thereof.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A scroll compressor comprising:

a hermetic housing, a fixed scroll element arranged within the hermetic housing and comprising a fixed end plate and a fixed spiral wrap extending from the fixed end plate, an orbiting scroll element arranged within the hermetic housing and comprising an orbiting end plate and an orbiting spiral wrap extending from the orbiting end plate, the fixed and orbiting spiral wraps being intermeshed with each other to define, with the fixed and orbiting end plates, pairs of compression pockets, a volume of the compression pockets decreasing from outer ends towards inner ends of the fixed and orbiting spiral wraps during orbiting movement of the orbiting scroll element, a radial inner pair of compression pockets comprising a direct pocket and an indirect pocket, a central main discharge port formed in the fixed end plate and configured to communicate the direct pocket with a discharge pressure volume formed within the hermetic housing, wherein an auxiliary discharge port is formed in the fixed end plate at a position close to an outer wall side of the fixed spiral wrap and adjacent the inner end of the fixed spiral wrap, and in that the auxiliary discharge port, during orbiting movement of the orbiting scroll element, is at least partially uncovered by the orbiting spiral wrap to communicate the indirect pocket with the discharge pressure volume, and wherein the orbiting scroll element is configured to substantially simultaneously communicate the direct pocket with the central main discharge port and the indirect pocket with the auxiliary discharge port at an initiation of a discharge process of the direct and indirect pockets.

2. The scroll compressor according to claim 1, wherein the auxiliary discharge port is formed by at least one auxiliary discharge hole formed in the fixed end plate.

3. The scroll compressor according to claim 2, wherein the at least one auxiliary discharge hole is cylindrical.

4. The scroll compressor according to claim 2, wherein the at least one auxiliary discharge hole has a diameter smaller than a thickness of the orbiting spiral wrap.

5. The scroll compressor according to claim 1, wherein the auxiliary discharge port is formed by several auxiliary discharge holes formed in the fixed end plate.

6. The scroll compressor according to claim 5, wherein the several auxiliary discharge holes are configured to be successively uncovered by the orbiting spiral wrap, during orbiting movement of the orbiting scroll element, to communicate the indirect pocket with the discharge pressure volume.

7. The scroll compressor according to claim 5, wherein the several auxiliary discharge holes are aligned along a curved line.

8. The scroll compressor according to claim 1, wherein the central main discharge port is formed in the fixed end plate at a position close to an inner wall side of the fixed spiral wrap and adjacent the inner end of the fixed spiral wrap.

9. The scroll compressor according to claim 1, wherein the fixed scroll element includes a sealing device arranged in an end face of the fixed spiral wrap and sealingly cooperating with the orbiting end plate of the orbiting scroll element.

10. The scroll compressor according to claim 3, wherein the at least one auxiliary discharge hole has a diameter smaller than a thickness of the orbiting spiral wrap.

11. The scroll compressor according to claim 2, wherein the auxiliary discharge port is formed by several auxiliary discharge holes formed in the fixed end plate.

12. The scroll compressor according to claim 3, wherein the auxiliary discharge port is formed by several auxiliary discharge holes formed in the fixed end plate.

13. The scroll compressor according to claim 4, wherein the auxiliary discharge port is formed by several auxiliary discharge holes formed in the fixed end plate.

14. The scroll compressor according to claim 6, wherein the several auxiliary discharge holes are aligned along a curved line.

15. The scroll compressor according to claim 2, wherein the central main discharge port is formed in the fixed end plate at a position close to an inner wall side of the fixed spiral wrap and adjacent the inner end of the fixed spiral wrap.

16. The scroll compressor according to claim 3, wherein the central main discharge port is formed in the fixed end plate at a position close to an inner wall side of the fixed spiral wrap and adjacent the inner end of the fixed spiral wrap.

17. The scroll compressor according to claim 4, wherein the central main discharge port is formed in the fixed end plate at a position close to an inner wall side of the fixed spiral wrap and adjacent the inner end of the fixed spiral wrap.

18. The scroll compressor according to claim 5, wherein the central main discharge port is formed in the fixed end plate at a position close to an inner wall side of the fixed spiral wrap and adjacent the inner end of the fixed spiral wrap.

19. The scroll compressor according to claim 6, wherein the central main discharge port is formed in the fixed end plate at a position close to an inner wall side of the fixed spiral wrap and adjacent the inner end of the fixed spiral wrap.

* * * * *